US011293368B2

(12) United States Patent
Braun et al.

(10) Patent No.: US 11,293,368 B2
(45) Date of Patent: Apr. 5, 2022

(54) METHOD FOR CHECKING THE FUNCTION OF A PRESSURE SENSOR IN THE AIR INTAKE TRACT OR EXHAUST GAS OUTLET TRACT OF AN INTERNAL COMBUSTION ENGINE IN OPERATION AND ENGINE CONTROL UNIT

(71) Applicant: Vitesco Technologies GmbH, Hannover (DE)

(72) Inventors: Tobias Braun, Undorf/Nittendorf (DE); Frank Maurer, Regenstauf (DE); Jürgen Dingl, Regensburg (DE); Sven-Michael Eisen, Regensburg (DE)

(73) Assignee: Vitesco Technologies GmbH, Regensburg (DE)

( * ) Notice: Subject to any disclaimer, the term of this patent is extended or adjusted under 35 U.S.C. 154(b) by 84 days.

(21) Appl. No.: 16/809,081

(22) Filed: Mar. 4, 2020

(65) Prior Publication Data

US 2020/0200113 A1 Jun. 25, 2020

Related U.S. Application Data

(63) Continuation of application No. PCT/EP2018/073707, filed on Sep. 4, 2018.

(30) Foreign Application Priority Data

Sep. 8, 2017 (DE) ..... 10 2017 215 849.2

(51) Int. Cl.
*F02D 41/22* (2006.01)
*F01N 11/00* (2006.01)
(Continued)

(52) U.S. Cl.
CPC ..... *F02D 41/222* (2013.01); *F01N 11/00* (2013.01); *F02D 41/009* (2013.01); *F02D 41/26* (2013.01);
(Continued)

(58) Field of Classification Search
CPC ..... F02D 41/22; F02D 41/222; F02D 41/009; F02D 41/26; F02D 2041/227;
(Continued)

(56) References Cited

U.S. PATENT DOCUMENTS 5,109,825 A 5/1992 Joos et al.
6,684,151 B1 1/2004 Ring
(Continued)

FOREIGN PATENT DOCUMENTS

DE 19927846 A1 12/2000
DE 102005027565 A1 12/2006
(Continued)

OTHER PUBLICATIONS

Korean Notice of Allowance dated Apr. 26, 2021 for corresponding Korean Patent Application No. 10-2020-7009848.
(Continued)

*Primary Examiner* — Robert A Werner

(57) ABSTRACT

A method for checking the function of a pressure sensor in the air intake tract or gas outlet tract of an internal combustion engine and to an engine control unit for carrying out the method and based on measuring dynamic pressure oscillations of the intake air or the exhaust gas by the relevant pressure sensor and, on the basis of the pressure oscillation signal obtained, respectively determining with the aid of a discrete Fourier transformation for a number of selected signal frequencies in each case a value of a specific operating characteristic of the internal combustion engine and deviation values of the values determined for the different signal frequencies from one another. Depending on whether deviation values determined fall below or exceed a predetermined limit value, the satisfactory function of the pressure sensor is confirmed, or a malfunction of the pressure sensor is diagnosed.

13 Claims, 3 Drawing Sheets

(51) Int. Cl.
*F02D 41/00* (2006.01)
*F02D 41/26* (2006.01)
*F02M 35/10* (2006.01)

(52) U.S. Cl.
CPC ..... *F02M 35/1038* (2013.01); *F02D 2200/04* (2013.01); *F02D 2200/0611* (2013.01); *F02D 2200/0614* (2013.01)

(58) Field of Classification Search
CPC ..... F02D 2041/228; F02D 2200/04; F02D 2200/0406; F02D 2200/0611; F02D 2200/0614; F01N 11/00; F02M 35/1038; G01M 15/09; G01L 27/007
USPC .... 701/102, 111, 114, 29.1, 29.2, 29.7–31.2; 123/435; 73/114.26, 114.27, 114.31, 73/114.37, 114.69, 114.76, 114.77
See application file for complete search history.

(56) References Cited

U.S. PATENT DOCUMENTS

| | | | | |
|---|---|---|---|---|
| 7,334,481 | B2 | 2/2008 | Correale | |
| 7,516,652 | B2 | 4/2009 | Schulz et al. | |
| 7,634,940 | B2 | 12/2009 | Hartmann et al. | |
| 8,631,688 | B1 | 1/2014 | Rayl | |
| 10,006,394 | B2 | 6/2018 | Hayashita et al. | |
| 2006/0190159 | A1 | 8/2006 | Iihoshi et al. | |
| 2006/0282200 | A1 | 12/2006 | Thiel et al. | |
| 2011/0000288 | A1* | 1/2011 | Wagner | F02D 41/222 73/114.33 |
| 2011/0083498 | A1 | 4/2011 | Verner et al. | |
| 2011/0232387 | A1 | 9/2011 | Sakurai | |
| 2017/0198649 | A1* | 7/2017 | Kainz | F02D 41/009 |
| 2018/0355815 | A1 | 12/2018 | Braun et al. | |
| 2018/0372008 | A1 | 12/2018 | Braun et al. | |
| 2019/0003413 | A1 | 1/2019 | Braun et al. | |
| 2020/0040830 | A1 | 2/2020 | Braun | |
| 2020/0063674 | A1 | 2/2020 | Braun et al. | |

FOREIGN PATENT DOCUMENTS

| | | | |
|---|---|---|---|
| DE | 102009027400 | A1 | 1/2011 |
| DE | 102015209665 | A1 | 12/2015 |
| DE | 102015226138 | B3 | 12/2016 |
| DE | 102015222408 | B3 | 3/2017 |
| DE | 102015224736 | A1 | 6/2017 |
| DE | 102015225922 | A1 | 6/2017 |
| DE | 102015226461 | A1 | 6/2017 |
| DE | 102016219584 | A1 | 4/2018 |
| DE | 102016222533 | A1 | 5/2018 |
| DE | 102017209112 | A1 | 12/2018 |
| DE | 102017209386 | A1 | 12/2018 |
| JP | S63195370 | A | 8/1988 |
| JP | S648337 | A | 1/1989 |
| JP | H11294234 | A | 10/1999 |
| JP | 2006153016 | A | 6/2006 |
| JP | 2006322935 | A | 11/2006 |
| KR | 900702210 | A | 12/1990 |
| KR | 20080085748 | A | 9/2008 |
| WO | 2014069194 | A1 | 5/2014 |
| WO | 2015144287 | A1 | 10/2015 |
| WO | 2016013211 | A1 | 1/2016 |

OTHER PUBLICATIONS

Office Action dated Apr. 10, 2018 from corresponding German Patent Application No. DE 10 2017 215 849.2.
International Search Report and Written Opinion dated Nov. 12, 2018 from corresponding International Patent Application No. PCT/EP2018/073706.
Chinese Search Report dated Nov. 8, 2021 for corresponding Chinese Patent Application No. 201880058109.7.

* cited by examiner

METHOD FOR CHECKING THE FUNCTION OF A PRESSURE SENSOR IN THE AIR INTAKE TRACT OR EXHAUST GAS OUTLET TRACT OF AN INTERNAL COMBUSTION ENGINE IN OPERATION AND ENGINE CONTROL UNIT

CROSS REFERENCE TO RELATED APPLICATIONS

This application is the U.S. national phase application of PCT International Application No. PCT/EP2018/073706, filed Sep. 4, 2018, which claims priority to German Patent Application No. DE 10 2017 215 849.2, filed Sep. 8, 2017, wherein the contents of such applications are incorporated herein by reference.

TECHNICAL FIELD

A method with which a respective pressure sensor, which is arranged for pressure measurement in the air intake tract or in the exhaust gas outlet tract of an internal combustion engine, can be checked for its fault-free function.

TECHNICAL BACKGROUND

Reciprocating internal combustion engines, which in this description are also referred to as internal combustion engines for short, have one or more cylinders, in each of which a reciprocating piston is arranged. To illustrate the principle of a reciprocating internal combustion engine, reference will be made below to FIG. 1, which shows by way of example a cylinder of an internal combustion engine, which is possibly also a multi-cylinder internal combustion engine, together with the most important functional units.

The respective reciprocating piston 6 is arranged in a linearly movable manner in the respective cylinder 2 and, together with the cylinder 2, encloses a combustion chamber 3. The respective reciprocating piston 6 is connected by means of a so-called connecting rod 7 to a respective crankpin 8 of a crankshaft 9, the crankpin 8 being arranged eccentrically with respect to the crankshaft axis of rotation 9*a*. As a result of the combustion of a fuel-air mixture in the combustion chamber 3, the reciprocating piston 6 is driven linearly "downward". The translational stroke movement of the reciprocating piston 6 is transmitted by means of the connecting rod 7 and crankpin 8 to the crankshaft 9 and is converted into a rotational movement of the crankshaft 9, which causes the reciprocating piston 6, after it passes through a bottom dead center in the cylinder 2, to be moved "upward" again in the opposite direction as far as a top dead center. To allow continuous operation of the internal combustion engine 1, it is necessary during a so-called working cycle of a cylinder 2 firstly for the combustion chamber 3 to be filled with the fuel-air mixture, for the fuel-air mixture to be compressed in the combustion chamber 3 and then ignited and burned with an expanding action in order to drive the reciprocating piston 6 and finally for the exhaust gas that remains after the combustion to be discharged from the combustion chamber 3. Continuous repetition of this sequence results in continuous operation of the internal combustion engine 1, with work being output in a manner proportional to the combustion energy.

Depending on the engine concept, a working cycle of the cylinder 2 is divided into two strokes distributed over one crankshaft rotation (360°) (two-stroke engine) or into four strokes distributed over two crankshaft rotations (720°) (four-stroke engine).

To date, the four-stroke engine has become established as a drive for motor vehicles. In an intake stroke, with a downward movement of the reciprocating piston 6, fuel-air mixture or else only fresh air (in the case of direct fuel injection) is introduced from the air intake tract 20 into the combustion chamber 3. During the following compression stroke, with an upward movement of the reciprocating piston 6, the fuel-air mixture or the fresh air is compressed in the combustion chamber 3, and possibly fuel is separately injected by means of an injection valve 5, which belongs to a fuel supply system, directly into the combustion chamber 3. During the following working stroke, the fuel-air mixture is ignited by means of an ignition plug 4, burned with an expanding action and expanded, outputting work, with a downward movement of the reciprocating piston 6. Finally, in an exhaust stroke, with another upward movement of the reciprocating piston 6, the remaining exhaust gas is discharged out of the combustion chamber 3 into the exhaust gas tract 30.

The delimitation of the combustion chamber 3 with respect to the air inlet tract 20 or exhaust gas tract 30 of the internal combustion engine is realized generally, and in particular in the example taken as a basis here, by means of inlet valves 22 and outlet valves 32. In the current prior art, said valves are actuated by means of at least one camshaft. The example shown has an inlet camshaft 23 for actuating the inlet valves 22 and has an outlet camshaft 33 for actuating the outlet valves 32. Between the valves and the respective camshaft there are normally provided yet further mechanical components (not shown here) for force transmission, which may also include a valve play compensation means (e.g. bucket tappet, rocker lever, finger-type rocker, tappet rod, hydraulic tappet etc.).

The inlet camshaft 23 and the outlet camshaft 33 are driven by means of the internal combustion engine 1 itself. For this purpose, the inlet camshaft 23 and the outlet camshaft 33 are coupled in each case by means of suitable inlet camshaft control adapters 24 and outlet camshaft control adapters 34, such as for example toothed gears, sprockets or belt pulleys using a control mechanism 40, which has for example a toothed gear mechanism, a control chain or a toothed control belt, in a predetermined position with respect to one another and with respect to the crankshaft 9 by means of a corresponding crankshaft control adapter 10, which is correspondingly formed as a toothed gear, sprocket or belt pulley, to the crankshaft 9. By means of this connection, the rotational position of the inlet camshaft 23 and of the outlet camshaft 33 is in principle defined in relation to the rotational position of the crankshaft 9. By way of example, FIG. 1 shows the coupling between the inlet camshaft 23 and the outlet camshaft 33 and the crankshaft 9 by means of belt pulleys and a toothed control belt.

The rotational angle covered by the crankshaft during one working cycle will hereinafter be referred to as the working phase or simply as the phase. A rotational angle covered by the crankshaft within one working phase is accordingly referred to as the phase angle. The respectively current crankshaft phase angle of the crankshaft 9 can be continuously detected by means of a position encoder 43 connected to the crankshaft 9, or to the crankshaft control adapter 10, and an assigned crankshaft position sensor 41. Here, the position encoder may be formed for example as a toothed gear with a multiplicity of teeth arranged so as to be distributed equidistantly over the circumference, wherein the number of individual teeth determines the resolution of the crankshaft phase angle signal.

It may possibly likewise be additionally the case that the present phase angles of the inlet camshaft 23 and of the outlet camshaft 33 can be continuously detected by means of corresponding position encoders 43 and assigned camshaft position sensors 42.

Since, as a result of the predetermined mechanical coupling, the respective crankpin 8, and with it the reciprocating piston 6, the inlet camshaft 23, and with it the respective inlet valve 22, and the outlet camshaft 33, and with it the respective outlet valve 32, move in a predetermined relationship with respect to one another and in dependence on the crankshaft rotation, these functional components run through the respective working phase synchronously with respect to the crankshaft. The respective rotational positions of the inlet camshaft, the outlet camshaft and the crankshaft and the stroke positions of the reciprocating piston 6, inlet valves 22 and outlet valves 32 can thus be related to the crankshaft phase angle of the crankshaft 9 predetermined by the crankshaft position sensor 41, taking into account the respective transmission ratios. In the case of an ideal internal combustion engine, it is thus possible for every specific crankshaft phase angle to be assigned a specific crankpin angle HZW (FIG. 2), a specific piston stroke, a specific inlet camshaft angle and thus a specific inlet valve stroke and also a specific outlet camshaft angle and thus a specific outlet valve stroke. That is to say, all of the stated components are, or move, in phase with the rotating crankshaft 9.

In modern internal combustion engines 1, it is however possible for there to be within the mechanical coupling path between the crankshaft 9 and the inlet camshaft 23 and the outlet camshaft 33, for example in a manner integrated into the inlet camshaft adapter 24 and the outlet camshaft adapter 34, additional positioning elements, which bring about a desired controllable phase shift between the crankshaft 9 and the inlet camshaft 23 and the outlet camshaft 33. These are known as so-called phase adjusters in so-called variable valve trains.

Also symbolically shown is an electronic, programmable engine control unit 50 (CPU) for controlling the engine functions, which is equipped with signal inputs 51 for receiving the various sensor signals and with signal and power outputs 52 for activating corresponding positioning units and actuators and with an electronic computing unit 53 and an assigned electronic memory unit 54.

For optimum operation of the internal combustion engine (with respect to emissions, consumption, power, running smoothness etc.), the fresh-gas charge introduced into the combustion chamber during the intake stroke should be known to the best possible extent in order to allow the further parameters for the combustion, such as for example the fuel quantity that is to be supplied, possibly directly injected, to be coordinated with it. The so-called charge exchange, i.e. the intake of fresh gas and the expulsion of the exhaust gas, is largely dependent on the control times of the inlet valves 22 and outlet valves 32, i.e. on the variation over time of the respective valve strokes in relation to the variation over time of the piston stroke and on the level and variation of the pressures in the air intake tract and in the exhaust gas outlet tract. In other words, the charge exchange during operation is dependent on the phase positions of the inlet and outlet valves in relation to the crankshaft phase angle, and thus the phase position of the reciprocating piston in interaction with the respective variation of pressure in the air intake tract and in the exhaust gas outlet tract.

The prior art for acquiring the fresh-gas charge and for coordinating the control parameters of the internal combustion engine with it comprises measuring a so-called reference internal combustion engine in all operating states occurring, for example in dependence on the rotational speed, the load, possibly the valve timings predeterminable by means of phase adjusters, possibly the operating parameters of an exhaust-gas turbocharger or a compressor etc., and storing these measured values or derivatives thereof or model approaches representing the behavior on the engine control unit of a corresponding series-production internal combustion engine. All structurally identical, series-produced internal combustion engines of the same type series are then operated with this reference dataset that is generated.

A deviation, caused for example by production tolerances, of the actual relative positions between inlet and outlet valves and the crankshaft phase angle or the reciprocating-piston position of a series-production internal combustion engine in relation to the ideal reference positions of the reference internal combustion engine, that is to say a phase difference of the inlet valve stroke, of the outlet valve stroke and possibly of the piston stroke in relation to the crankshaft phase angle predetermined by the crankshaft position sensor, or the phase position of the crankshaft, has the effect that the fresh-gas charge actually drawn in deviates from the fresh-gas charge determined as a reference, and thus the control parameters based on the reference dataset are not optimal. A deviation of the current measured values for the respective pressure in the air intake tract and in the exhaust gas outlet tract also leads to errors in the determination of the fresh gas charge actually taken in. Other sources of error that can have an adverse impact on the operating behavior of the internal combustion engine are, for example, a different fuel composition, different trimming of the intake tract or exhaust gas tract, different fuel injection times, different fuel injection quantities and possibly different compression ratios. During the operation of the internal combustion engine, these errors can have considerable adverse effects with respect to emissions, consumption, power, running smoothness etc.

Possible causes of the described deviations may be for example:

- production and/or assembly tolerances of the mechanical components involved, and
- effects of wear during operation and also
- effects of deformation, elastic or plastic, resulting from high mechanical loading states.

The previous solution to the problem described, according to the current state of the art, lies in principle in the recurring or continuous determination and quantification of the deviations that occur between the reference internal combustion engine and the series-production internal combustion engine during operation, in order to be able to take appropriate measures for correction or compensation by means of adaptation of control parameters.

To further increase the accuracy, and possibly to check the plausibility and monitor the determination of the aforementioned deviations, methods that work independently of corresponding position sensors have been developed in the recent past.

In the case of the aforementioned methods for recurring or continuous determination of the stated deviations, dynamic pressure oscillations that can be assigned to the respective cylinder are measured in the air intake tract or in the exhaust gas outlet tract of the relevant internal combustion engine during operation, and a corresponding pressure oscillation signal is generated from them. At the same time, a crankshaft phase angle signal is determined.

Under the term "air intake tract" or else simply "intake tract", "intake system" or "inlet tract" of an internal combustion engine, a person skilled in the art subsumes all components that serve for supplying air to the respective combustion chambers of the cylinders, and thus define the so-called air path. These terms may include, for example, an air filter, an intake pipe, an intake manifold or distributor pipe or, for short, suction pipe, a throttle flap valve, as well as possibly a compressor and the intake opening in the cylinder and/or the inlet duct of the cylinder.

By contrast, the term "exhaust gas outlet tract" or else simply "outlet tract", "exhaust gas tract" or "exhaust gas system" subsumes all the components through which the exhaust gas flows out, and thus form the so-called exhaust gas path, such as for example: the outlet opening or outlet duct of the respective cylinder, exhaust gas pipes, exhaust gas recirculation components, particle filters, catalytic converters and silencers.

The phase position and/or the amplitude of at least one selected signal frequency of the measured pressure oscillations in relation to the crankshaft phase angle signal are determined from the pressure oscillation signal with the aid of a discrete Fourier transformation. Furthermore, on the basis of the determined phase position and/or amplitude of at least one respective selected signal frequency, using appropriate reference values or reference characteristics, the current values of the stated deviations are determined. For this purpose, the reference values or reference characteristics were previously determined on an ideal reference internal combustion engine of the same type and stored in corresponding characteristic maps or were currently determined by means of a respective algebraic model function.

On the basis of the determined deviations, corrections or adaptations of the control parameters of the internal combustion engine are then possibly made in the control unit, depending on the deviations determined.

For example, document DE 10 2015 209 665 A1 discloses a method for identifying valve timings of an internal combustion engine. As described above, the phase angles of selected signal frequencies of the measured pressure oscillation are thereby determined. On the basis of the determined phase angles, the valve timings of the relevant internal combustion engine are then determined using reference phase angles and associated reference valve timings of the same signal frequencies of the pressure oscillations of a reference internal combustion engine and/or a model function derived from them.

Another method for the combined identification of a piston stroke phase difference, an inlet-valve stroke phase difference and an outlet-valve stroke phase difference of an internal combustion engine is known from document DE 10 2015 222 408 B3. Here, too, discrete Fourier transformation is used to determine the phase positions of selected signal frequencies of the measured pressure oscillations in the inlet and/or outlet tract in relation to the crankshaft phase angle signal. On this basis, depending on the inlet-valve stroke phase difference and outlet-valve stroke phase difference, standing lines of the same phase positions of the selected signal frequencies are determined and a common intersection of the determined lines is determined by a signal frequency-dependent phase shift.

The inlet-valve stroke phase difference and the outlet-valve stroke phase difference are determined from the determined common intersection point, and the piston stroke phase difference is determined from the value of the phase shifts that have taken place.

The documents DE 10 2015 226 138 B3 and DE 10 2015 226 461 A1 each relate to a method for determining the composition of the fuel used to operate an internal combustion engine. These methods are also based on the measurement and analysis of the pressure oscillations in the inlet tract of the relevant internal combustion engine by means of a discrete Fourier transformation. Here, for example, in addition to the determined actual phase position of the selected signal frequency in the case of suction-synchronous fuel injection, in the same way, without fuel injection or with direct fuel injection into the closed combustion chamber, a further comparison phase position of the selected signal frequency and the actual phase position difference between the two are determined. Then the fuel composition of the fuel currently being used is determined using reference phase position differences of the same signal frequency for different fuel compositions.

A method for determining the start of injection time and the injection quantity of the fuel in normal operation of an internal combustion engine, likewise based on measured pressure oscillations in the inlet tract of the internal combustion engine, is known from document DE 10 2015 226 461 A1.

Other methods based on the measurement of dynamic pressure oscillations in the intake tract or exhaust gas tract and their analysis using discrete Fourier transformation, such as for example:

- the combined identification of phase differences between the inlet valve stroke and the outlet valve stroke of an internal combustion engine;
- the determination of the compression ratio of an internal combustion engine;
- the monitoring of deviations occurring in the valve train of an internal combustion engine and
- the determination of the current trimming of the inlet tract of an internal combustion engine in operation, are disclosed in the German patent applications with the application numbers 10 2016 219 584.0; 10 2017 209 112.6; 10 2016 222 533.2 and 10 2017 209386.2.

When using the aforementioned methods, faulty pressure oscillation signals, for example due to a defect or an inadequate function of the pressure sensor, can result in considerable deteriorations in the operating behavior, and in particular in the exhaust gas behavior, of the internal combustion engine. For this reason, it is important, and in some cases even prescribed by law, to ensure the satisfactory, error-free functioning of such components that influence the exhaust gas behavior over the entire operating life of the respective internal combustion engine or to detect malfunctions in operation.

What is needed is a method for checking the function of a pressure sensor in the air intake tract or exhaust gas outlet tract of an internal combustion engine.

Figure 1:
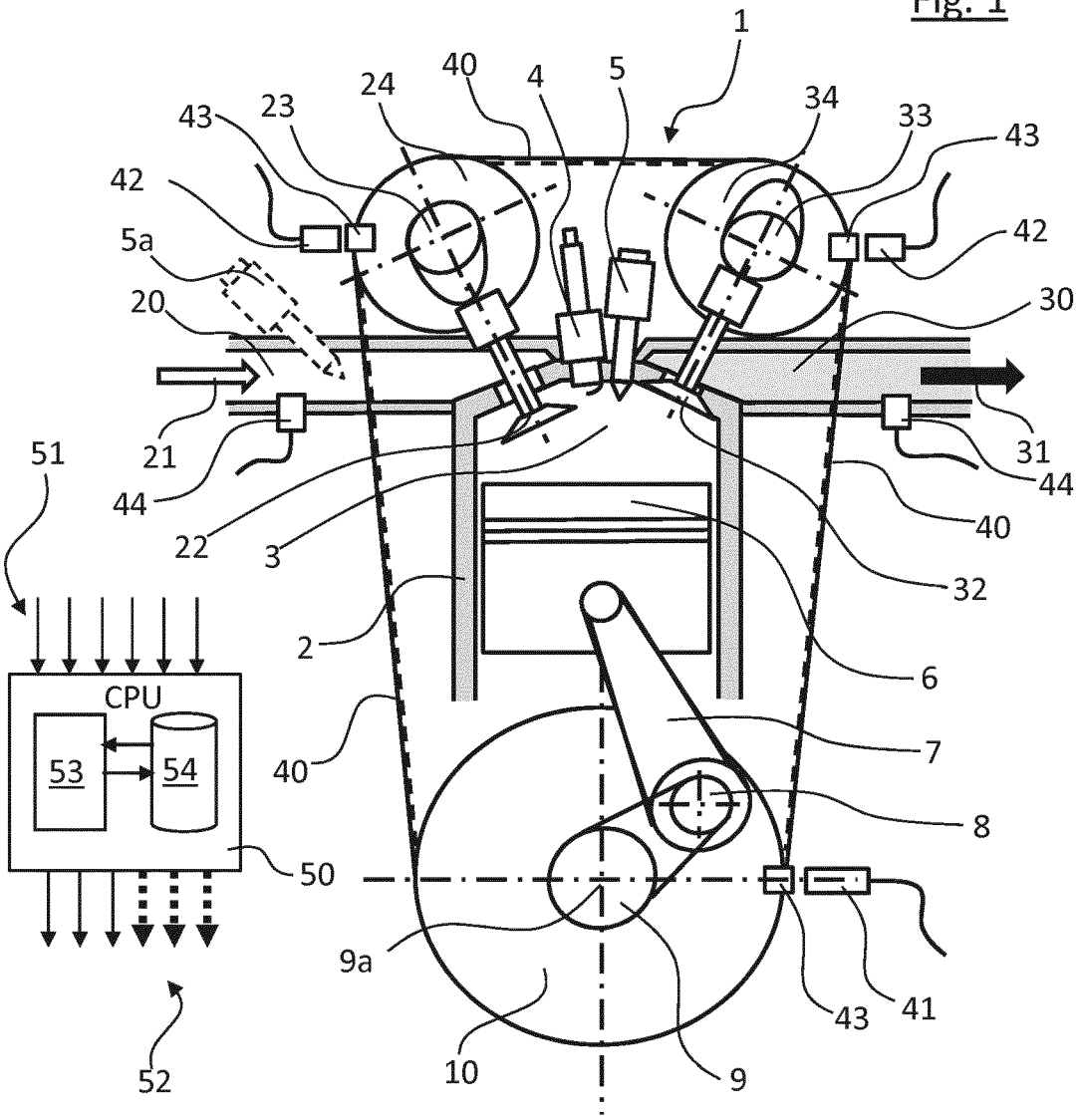
FIG. 1 shows a simplified schematic drawing to explain the structure and function of a reciprocating internal combustion engine.

Parts which are identical in terms of function and designation are denoted by the same reference signs throughout the figures.

DETAILED DESCRIPTION

The following detailed description includes references to the accompanying drawings, which form a part of the detailed description. The drawings show, by way of illustration, specific embodiments in which the apparatus may be practiced. These embodiments, which are also referred to herein as "examples" or "options," are described in enough detail to enable those skilled in the art to practice the present embodiments. The embodiments may be combined, other embodiments may be utilized, or structural or logical changes may be made without departing from the scope of the invention. The following detailed description is, therefore, not to be taken in a limiting sense and the scope of the invention is defined by the appended claims and their legal equivalents.

The present disclosure provides a simple, inexpensive and reliable method by which a malfunction of a pressure sensor arranged in the air intake tract or exhaust gas outlet tract of an internal combustion engine in operation, in particular in relation to its dynamic behavior, can be determined reliably and promptly.

According to the method for checking the function of a pressure sensor in the air intake tract or exhaust gas outlet tract of an internal combustion engine in operation, the dynamic pressure oscillations of the intake air in the air intake tract or of the exhaust gas in the exhaust gas outlet tract of the relevant internal combustion engine are measured in operation by means of the relevant pressure sensor and a corresponding pressure oscillation signal is generated from them. On the basis of this pressure oscillation signal, a value of a specific operating characteristic of the internal combustion engine is respectively determined with the aid of a discrete Fourier transformation for a number of selected signal frequencies. By comparing the determined values with one another, deviation values of the values of the operating characteristic determined for different signal frequencies from one another are then determined. These deviation values are then used to assess the function of the respective pressure sensor, the satisfactory function of the pressure sensor being confirmed if none of the determined deviation values exceeds a predetermined deviation limit value, and a malfunction of the pressure sensor being diagnosed if at least one of the determined deviation values exceeds a predetermined deviation limit at least once.

The advantages of the method are that, purely on the basis of the pressure oscillation signal of the pressure sensor to be checked itself, the function of this pressure sensor can be checked without additional sensors. Measurements and analyses of the pressure oscillation signal that are in any case carried out repeatedly during operation can also be used to a great extent for this purpose, which ensures prompt detection of a malfunction of the pressure sensor.

For the analysis of the pressure oscillation signal, it is subjected to a discrete Fourier transformation (DFT). For this purpose, an algorithm known as a fast Fourier transformation (FFT) may be used for the efficient calculation of the DFT. By means of DFT, the pressure oscillation signal is thus broken down into individual signal frequencies, which can thereafter be separately analyzed with respect to their amplitude and the phase position in a simplified manner.

It has been found in the present case that malfunctions of a pressure sensor, in particular when measuring highly dynamic pressure oscillations, have different effects on the different frequency components of the pressure oscillation signal referred to as signal frequencies. If there are greatly different values for different signal frequencies when determining a specific operating characteristic on the basis of the pressure oscillation signal, then it can be assumed that there is a malfunction, or at least an impairment, of the satisfactory function of the pressure sensor. The method according to the invention takes advantage of this by determining a current value of the operating characteristic for a number of signal frequencies that differ from one another and comparing these values with one another. This can be performed for example by simply forming a difference between two values in each case. It is possible in each case to compare just the highest value with the lowest value or each value with each other value. The difference values determined in this way are referred to here generally as deviation values. For the permissible maximum size of the deviation value, a deviation limit value is set in advance, for example when specifying or measuring the respective sensor type. This deviation limit value is used when carrying out the method for comparison with the determined deviation values, the satisfactory function of the pressure sensor being confirmed if none of the determined deviation values exceeds the predetermined deviation limit value and, on the other hand, a malfunction of the pressure sensor being diagnosed if at least one of the determined deviation values or at least the largest deviation value reaches or exceeds the predetermined deviation limit value at least once, that is at least during one measurement run.

A further embodiment of the method according to the invention takes advantage of the knowledge that malfunctions of a pressure sensor have different effects both on the phase position and on the amplitude of the respective signal frequencies. Accordingly, this embodiment of the method is wherein a crankshaft phase angle signal is determined at the same time as the pressure oscillation signal and the phase position and/or the amplitude of the selected signal frequencies of the measured pressure oscillations are determined in relation to the crankshaft phase angle signal and in that, on the basis of the respectively determined phase position or amplitude or phase position and amplitude of the respective signal frequency, a value of a specific operating characteristic of the internal combustion engine is determined.

The crankshaft phase angle signal required for carrying out the method according to the invention can be determined by means of a toothed gear connected to the crankshaft and by means of a Hall sensor. Such a sensor arrangement is likewise already provided in modern internal combustion engines for other purposes. The crankshaft phase angle signal generated by means of said sensor arrangement can be easily jointly utilized by the method according to the invention. This has the advantage that no additional sensor has to be provided, and therefore no additional costs are incurred, for carrying out the method according to the invention.

This embodiment is particularly advantageous whenever the determination of the corresponding operating characteristic is also determined on the phase position or amplitude or phase position and amplitude of a respective signal frequency.

In further embodiments of the method, the specific operating characteristic of the internal combustion engine is one or more of the following operating parameters: an inlet-valve stroke phase position, an outlet-valve stroke phase position, a piston stroke phase position, a fuel composition, a start time of the fuel injection, an injection quantity of the fuel injection, a compression ratio of the cylinders, a trimming of the inlet tract and a valve train deviation value. To determine these stated operating parameters on the basis of the pressure oscillation signal determined in the air intake tract or exhaust gas outlet tract, reference is made here to the disclosure of the documents mentioned in the introduction with respect to the prior art, in which the individual methods are explained in detail.

When using a number of the stated operating parameters as an operating characteristic, for example after determining a first deviation value of a specific first operating characteristic that goes beyond the deviation limit value, a further deviation value can first be determined on the basis of a further specific operating characteristic in order to confirm the first deviation value.

The advantages of using the stated operating parameters as an operating characteristic are that these operating parameters are in any case continuously determined in operation and the additional effort for checking the function of the pressure sensor can thus be kept very low.

For carrying out the method according to the invention, the selected signal frequencies advantageously correspond to the intake frequency as a fundamental frequency or the 1st harmonic and further multiples, that is to say the 2nd to nth, of the so-called "harmonic" of the intake frequency of the internal combustion engine.

Here, the intake frequency in turn uniquely relates to the rotational speed of the internal combustion engine.

For these selected signal frequencies, it is then possible for example, using a crankshaft phase angle signal recorded in parallel, to determine the phase position referred to in this context as the phase angle and the amplitude of the selected signal frequencies in relation to the crankshaft phase angle.

This results in particularly unambiguous and thus easy-to-evaluate results when determining the respective specific operating characteristic, whereby a high degree of accuracy of the results can be ensured.

The method, like the individual methods for determining the stated operating parameters, can advantageously be carried out on an electronic programmable engine control unit (CPU) of the relevant internal combustion engine. This has the advantage that no separate control or computing device is required and the algorithms of the method can be integrated into the corresponding sequences of the engine control programs, and in particular into the algorithms for determining the operating parameters.

In a further configuration of the above-described embodiment of the method according to the invention on an engine control unit, if a malfunction of the pressure sensor is diagnosed, the internal combustion engine continues to operate in an emergency mode or an emergency stop of the engine is initiated by means of the engine control unit. As an alternative or in addition to this, an error message, which for example signals to a vehicle driver that the pressure sensor has been detected as defective, is output.

This advantageously ensures that the respective internal combustion engine is not operated with faulty manipulated variables based on a faulty pressure oscillation signal from the corresponding pressure sensor, which cannot guarantee compliance with the emission limits.

The engine control unit according to the invention for controlling an internal combustion engine has at least one electronic computing unit, at least one electronic memory unit, a number of signal inputs and a number of signal outputs. Optionally, the electronic computing unit may also have a number of computing units and memory units operating separately or in combination. In this case, a program code and calculation parameters are stored in at least one of the electronic computing units and/or in the electronic memory units, for carrying out the previously described method according to the invention according to one of the described embodiments, by means of the engine control unit, during the intended operation of the internal combustion engine.

The advantage of the engine control unit according to the invention is that the program code and calculation parameters for carrying out the method according to the invention can be directly embedded in the routines and program sequences for controlling the operation of the internal combustion engine and that likewise no separate control units are required.

The schematic drawing shown in FIG. 1 to explain the structure and function of a reciprocating internal combustion engine has already been described in the introduction. However, it should be noted that the engine control unit 50 shown has at least one electronic computing unit 53, at least one electronic memory unit 54, a number of signal inputs 51 and a number of signal outputs 52, which can also be supplemented by power outputs. Furthermore, a program code and calculation parameters by means of which the method according to the invention, as described above, is carried out by means of the engine control unit 50 during the intended operation of the internal combustion engine are stored in the electronic computing unit 53 and/or in the electronic memory unit 54.

Figure 2:
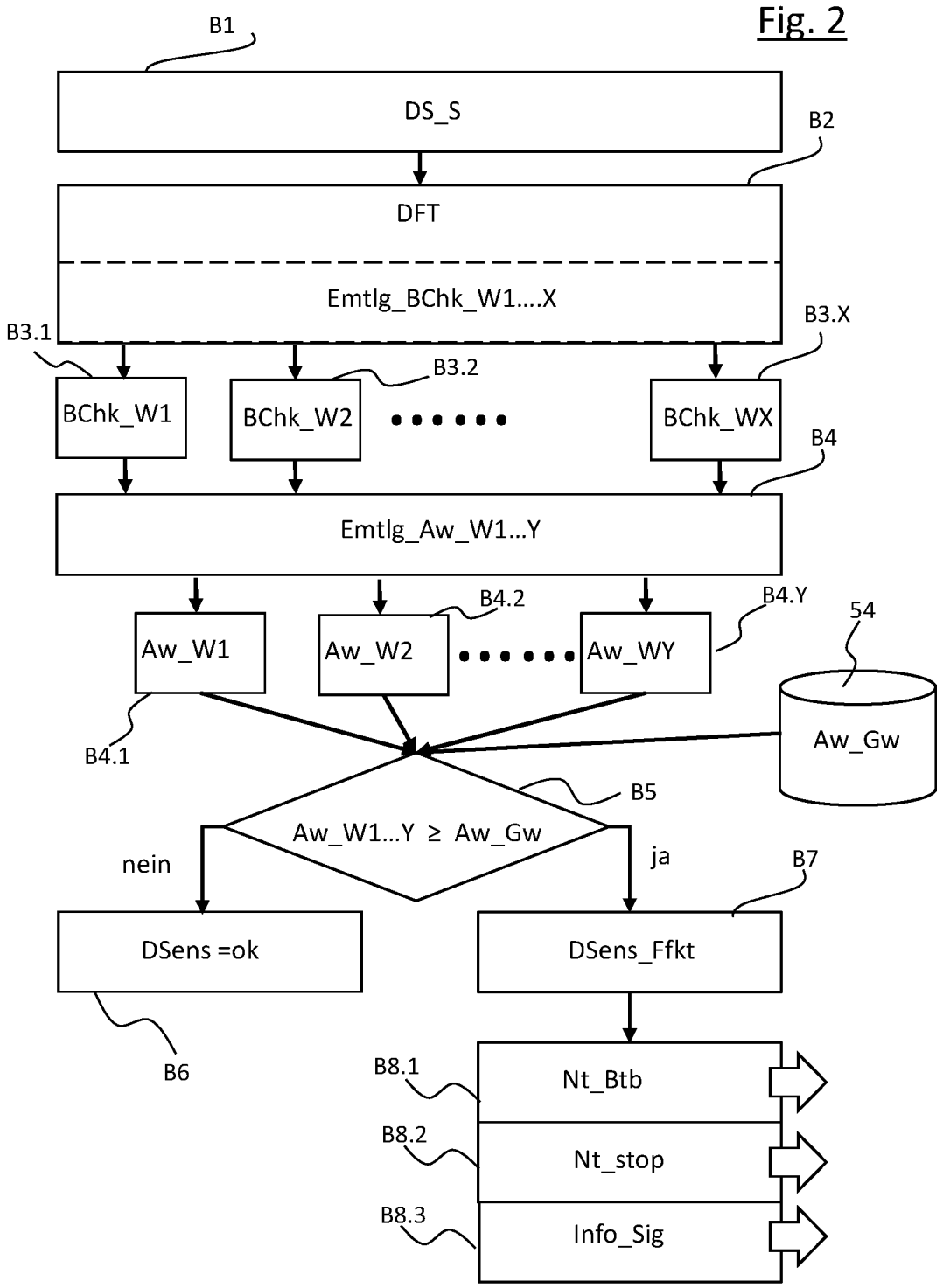
FIG. 2 shows a simplified block diagram to illustrate an embodiment of the method according to one or more embodiments.

FIG. 2 shows a simplified block diagram in which the method steps are shown summarized in the individual blocks.

At the beginning, dynamic pressure oscillations of the intake air in the air intake tract 20 and/or of the exhaust gas in the exhaust gas outlet tract 30 of the relevant internal combustion engine 1 are measured in operation by means of the relevant pressure sensor 44, and a corresponding pressure oscillation signal DS_S, which is represented by the block identified by B1, is generated from them.

In the block labeled B2, the determination of the selected operating characteristic values Emtlg_BChk_W1 . . . X takes place on the basis of the pressure oscillation signal DS_S with the aid of discrete Fourier transformation DFT, which is represented by block B2. On the basis of the pressure oscillation signal DS_S, a value of the specific operating characteristic BChk_W1, BChk_W2 to BChk_WX (also BChk_W1 . . . X) of the internal combustion engine 1 is respectively determined for a number of selected signal frequencies SF1, SF2 to SFX (also SF1 . . . X) with the aid of discrete Fourier transformation DFT. The individual determined values of the operating characteristic, BChk_W1, BChk_W2 to BChk_WX, are represented in FIG. 2 by blocks B3.1, B3.2 to B3.X.

One or more operating parameters determined on the basis of the same pressure oscillation signal DS_S can be used as a specific operating characteristic, according to one of the methods from the prior art mentioned in the introduction. For example, an inlet valve stroke phase position, an outlet valve stroke phase position or a piston stroke phase position, which can be determined for example by one of the methods disclosed in the prior art, may be used as a specific operating characteristic. A fuel composition, a start time of the fuel injection, an injection quantity of the fuel injection, a compression ratio of the cylinders, a trimming of the inlet tract and a valve train deviation value, determined according to the methods disclosed in the patent documents mentioned at the beginning, can also be used as a specific operating characteristic.

If for example a number of the aforementioned operating parameters are determined from the pressure oscillation signal DS_S of the pressure sensor 44 to be checked, it is advisable to carry out the method on the basis of these multiple operating parameters as a respective operating characteristic and to compare the results for verification or confirmation of the individual result. In this way, possibly incorrect assessments based on so-called outlier measured values can be avoided.

In the further course of the method, according to block B4, the determination of deviation values W1 . . . Y Emtlg_Aw_W1 . . . Y, takes place, where the deviation values Aw_W1 . . . Y are determined which represent deviations of the operating characteristic values BChk_W1 . . . X of different signal frequencies SF1 . . . X from one another. This can be performed for example by comparing, in particular forming a difference between, two determined values in each case. For example, the values most far apart may first be determined and the difference between these two values formed. Whereby a maximum deviation value is found. Or all of the determined values of the operating characteristic BChk_W1 . . . X are compared with all of the other values of the operating characteristic, which results in a number of deviation values Aw_W1, Aw_W2 to Aw_WY (also Aw_W1 . . . Y), which are shown by way of example in FIG. 2 by those blocks designated by B4.1, B4.2 to B4.Y.

In the further course of the method, a respective comparison of the determined deviation values Aw_W1, Aw_W2 to Aw_WY with a predetermined deviation limit value Aw_Gw takes place to ascertain whether at least one of the determined deviation values Aw_W1, Aw_W2 to Aw_WY reaches or exceeds the deviation limit value Aw_Gw, i.e. Aw_W1 . . . Y≥Aw_Gw. This is illustrated in block B5.

For this purpose, the deviation limit value Aw_Gw was determined for example empirically or arithmetically in advance of the intended operation of the internal combustion engine 1 and stored in the electronic memory unit 54 of the engine control unit 50 (CPU), which is also shown in FIG. 2. The method can similarly be carried out on the same engine control unit 50, stored there in the form of program code.

On the basis of the result of the aforementioned comparison Aw_W1 . . . Y≥Aw_Gw, the satisfactory function of the pressure sensor 44 is confirmed, DSens=ok, as shown in block B6, if none of the determined deviation values Aw_W1 . . . Y reaches or exceeds a predetermined deviation limit value Aw_Gw.

By contrast, a malfunction DSens_Ffkt of the pressure sensor (44) is diagnosed, as shown in block B7, if at least one of the determined deviation values Aw_W1 . . . Y reaches or exceeds a predetermined deviation limit value Aw_Gw at least once.

In a continuation of the method, if a malfunction DSens_Ffkt of the pressure sensor 44 has been diagnosed, the engine control unit 50 can be used to switch the internal combustion engine 1 into an emergency operating mode Nt-Btb and continue to operate it as shown in block B8.1, or an emergency stop of the internal combustion engine 1, Nt_stop, can be initiated, as shown in block B8.2. Similarly, optionally as an alternative or in addition to this, an error message (Info_Sig) is output, as represented by block B8.3, signaling for example to a vehicle driver that the pressure sensor has been detected as defective.

Figure 3:
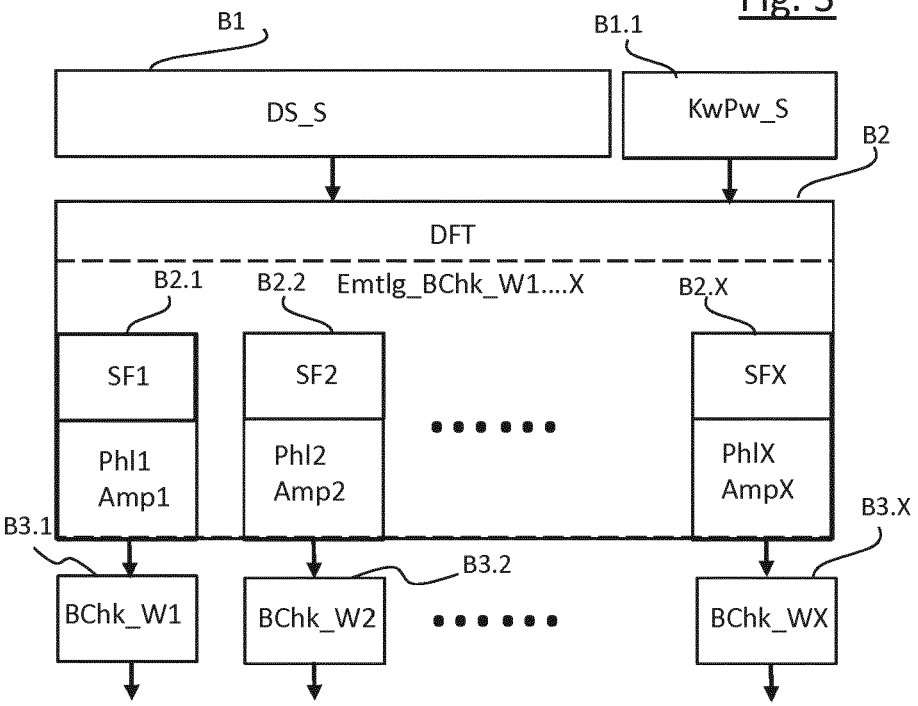
FIG. 3 shows a further detailed section from the simplified block diagram according to FIG. 1 for a further detailed representation of an embodiment.

FIG. 3 shows a further detailed section from the simplified block diagram according to FIG. 1 for a further detailed representation of an embodiment of the method according to the invention. It is shown here by means of block B1.1 that a crankshaft phase angle signal Kw_Pw is determined at the same time as the pressure oscillation signal DS-S. This is performed for example by means of a crankshaft position sensor 41 that is provided in any case on the internal combustion engine, as shown in FIG. 1.

Furthermore, block B2 is further detailed in FIG. 3 in order to show by blocks B2.1, B2.2 to B2.X that, for the selected signal frequencies SF1, SF2 to SFX (also SF1 . . . X) of the measured pressure oscillation signal DS_S, in each case the phase position Phl1, Phl2 to PhlX (also Phl1 . . . X) and/or the amplitude Amp1, Amp2 to AmpX (also Amp1 . . . X) of the selected signal frequencies SF1 . . . X in relation to the crankshaft phase angle signal Kw_Pw_S are determined. On the basis of the respectively determined phase position Phl1 . . . X or amplitude Amp1 . . . X or phase position Phl1 . . . X and amplitude Amp1 . . . X, the one value in each case of a specific operating characteristic BChk_W1 . . . X of the internal combustion engine 1 is determined for the respective signal frequency SF1 . . . X.

Summarized again briefly, the invention relates to a method for checking the function of a pressure sensor in the air intake tract or exhaust gas outlet tract of an internal combustion engine in operation and to an engine control unit for carrying out the method and is based on measuring dynamic pressure oscillations of the intake air in the air intake tract or the exhaust gas in the exhaust gas outlet tract of the relevant internal combustion engine during operation by means of the relevant pressure sensor and, on the basis of the pressure oscillation signal obtained, determining with the aid of a discrete Fourier transformation for a number of selected signal frequencies in each case a value of a specific operating characteristic of the internal combustion engine and deviation values of the values determined for the different signal frequencies from one another. Depending on whether deviation values determined fall below or exceed a predetermined limit value, the satisfactory function of the pressure sensor is confirmed or a malfunction of the pressure sensor is diagnosed.

This makes it possible to monitor the satisfactory function of the pressure sensor and, in the event of a failure, to initiate appropriate measures that prevent the internal combustion engine from malfunctioning and possibly on that basis producing increased emissions of pollutants.

The above description is intended to be illustrative, and not restrictive. Many other embodiments will be apparent to those of skill in the art upon reading and understanding the above description. Embodiments discussed in different portions of the description or referred to in different drawings can be combined to form additional embodiments of the present application. The scope should, therefore, be determined with reference to the appended claims, along with the full scope of equivalents to which such claims are entitled.

The invention claimed is:

1. A method for checking the function of a pressure sensor in an air intake tract or exhaust gas outlet tract of an internal combustion engine in operation, comprising:

dynamic pressure oscillations of intake air in the air intake tract or of the exhaust gas in the exhaust gas outlet tract of the internal combustion engine are measured during operation by a relevant pressure sensor and a corresponding pressure vibration signal (DS_S) is generated from them; and wherein, on the basis of a pressure oscillation signal (DS_S), a value of a specific operating characteristic (BChk_W1 . . . X) of the internal combustion engine is respectively determined for a number of selected signal frequencies (SF1 . . . X) with aid of discrete Fourier transformation (DFT) and deviation values (Aw_W1 . . . Y) of the values of the operating characteristic (BChk_W1 . . . X) determined for different signal frequencies (SF1 . . . X) from one another are determined;

wherein a satisfactory function of the pressure sensor is confirmed (DSens=ok) if none of the determined deviation values (Aw_W1 . . . Y) reaches or exceeds a specified deviation limit value (Aw_Gw); and wherein a malfunction (DSens_Ffkt) of the pressure sensor is diagnosed if at least one of the determined deviation values (Aw_W1 . . . Y) reaches or exceeds a predetermined deviation limit value (Aw_Gw) at least once.

2. The method as claimed in claim 1, wherein a crankshaft phase angle signal (Kw_Pw) is determined at the same time as the pressure oscillation signal (DS-S) and a phase position and/or amplitude of the selected signal frequencies (SF1 . . . X) of the measured pressure oscillation signal (DS_S) are determined in relation to a crankshaft phase angle signal (Kw_Pw_S) and in that on the basis of a respectively determined phase position or amplitude or phase position and amplitude, the one value in each case of a specific operating characteristic (BChk_W1 . . . X) of the internal combustion engine is determined.

3. The method as claimed in claim 1, wherein the specific operating characteristic of the internal combustion engine is one or more of the following operating parameters: an inlet-valve stroke phase position, an outlet-valve stroke phase position, a piston stroke phase position, a fuel composition, a start time of the fuel injection, an injection quantity of the fuel injection, a compression ratio of cylinders, a trimming of the inlet tract and a valve train deviation value.

4. The method as claimed in claim 2, wherein the specific operating characteristic of the internal combustion engine is one or more of the following operating parameters: an inlet-valve stroke phase position, an outlet-valve stroke phase position, a piston stroke phase position, a fuel composition, a start time of the fuel injection, an injection quantity of the fuel injection, a compression ratio of the cylinders, a trimming of the inlet tract and a valve train deviation value.

5. The method as claimed in claim 1, wherein the selected signal frequencies (SF1 . . . X) are intake frequency and at least one further multiple of the intake frequency of the internal combustion engine.

6. The method as claimed in claim 2, wherein the selected signal frequencies (SF1 . . . X) are the intake frequency and at least one further multiple of the intake frequency of the internal combustion engine.

7. The method as claimed in claim 3, wherein the selected signal frequencies (SF1 . . . X) are the intake frequency and at least one further multiple of the intake frequency of the internal combustion engine.

8. The method as claimed in claim 1, wherein the method is carried out on an electronic programmable engine control unit of the relevant internal combustion engine.

9. The method as claimed in claim 2, wherein the method is carried out on an electronic programmable engine control unit of the relevant internal combustion engine.

10. The method as claimed in claim 3, wherein the method is carried out on an electronic programmable engine control unit of the relevant internal combustion engine.

11. The method as claimed in claim 4, wherein the method is carried out on an electronic programmable engine control unit of the relevant internal combustion engine.

12. The method as claimed in claim 8, wherein, if a malfunction (DSens_Ffkt) of the pressure sensor is diagnosed, the internal combustion engine continues to operate in an emergency mode (Nt-Btb) or an emergency stop of the internal combustion engine (Nt_stop) is initiated by means of the engine control unit, wherein, as an alternative or in addition to this, in each case an error message (Info_Sig) is output.

13. An engine control unit for controlling an internal combustion engine comprising:

at least one electronic computing unit;

at least one electronic memory unit;

a number of signal inputs and a number of signal outputs;

wherein a program code and calculation parameters are stored in the electronic computing unit and/or in the electronic memory unit, for carrying out dynamic pressure oscillations of the intake air in the air intake tract or of exhaust gas in exhaust gas outlet tract of the relevant internal combustion engine are measured during operation by a relevant pressure sensor and a corresponding pressure vibration signal (DS_S) is generated from them; and wherein, on the basis of the pressure oscillation signal (DS_S), a value of a specific operating characteristic (BChk_W1 . . . X) of the internal combustion engine is respectively determined for a number of selected signal frequencies (SF1 . . . X) with the aid of discrete Fourier transformation (DFT) and deviation values (Aw_W1 . . . Y) of the values of the operating characteristic (BChk_W1 . . . X) determined for different signal frequencies (SF1 . . . X) from one another are determined;

wherein the satisfactory function of the pressure sensor is confirmed (DSens=ok) if none of the determined deviation values (Aw_W1 . . . Y) reaches or exceeds a specified deviation limit value (Aw_Gw); and wherein a malfunction (DSens_Ffkt) of the pressure sensor is diagnosed if at least one of the determined deviation values (Aw_W1 . . . Y) reaches or exceeds a predetermined deviation limit value (Aw_Gw) at least once.

* * * * *